US010422052B2

(12) United States Patent
Hahm et al.

(10) Patent No.: US 10,422,052 B2
(45) Date of Patent: Sep. 24, 2019

(54) METHOD OF MANUFACTURING HIGH STRENGTH SYNTHETIC FIBERS

(71) Applicant: KOREA INSTITUTE OF INDUSTRIAL TECHNOLOGY, Cheonan-si (KR)

(72) Inventors: Wan Gyu Hahm, Suwon-si (KR); In Woo Nam, Namyangju-si (KR); Seung Jin Lee, Ansan-si (KR); Do Kun Kim, Ansan-si (KR); Ki Sub Lim, Incheon (KR); Joo Hyung Lee, Seoul (KR); Gyu Dong Lee, Ansan-si (KR); Yeong Og Choi, Suwon-si (KR); Byeong Jin Yeang, Hwaseong-si (KR)

(73) Assignee: KOREA INSTITUTE OF INDUSTRIAL TECHNOLOGY, Cheonan-si (KR)

( * ) Notice: Subject to any disclaimer, the term of this patent is extended or adjusted under 35 U.S.C. 154(b) by 0 days.

(21) Appl. No.: 15/556,859

(22) PCT Filed: Mar. 9, 2016

(86) PCT No.: PCT/KR2016/002368
§ 371 (c)(1),
(2) Date: Sep. 8, 2017

(87) PCT Pub. No.: WO2016/144105
PCT Pub. Date: Sep. 15, 2016

(65) Prior Publication Data

US 2018/0051392 A1 Feb. 22, 2018

(30) Foreign Application Priority Data

Mar. 9, 2015 (KR) ..... 10-2015-0032554
Jan. 22, 2016 (KR) ..... 10-2016-0008126

(51) Int. Cl.
*D01D 5/12* (2006.01)
*D01D 5/16* (2006.01)
(Continued)

(52) U.S. Cl.
CPC ..... *D01D 5/084* (2013.01); *D01D 4/02* (2013.01); *D01D 5/088* (2013.01); *D01D 5/098* (2013.01);
(Continued)

(58) Field of Classification Search
CPC ..... D01D 5/084; D01D 5/088; D01D 5/098; D01D 5/12; D01D 5/16; D01D 5/253;
(Continued)

(56) References Cited

U.S. PATENT DOCUMENTS 3,491,405 A * 1/1970 Richard ..... D01D 1/04 425/378.2
5,250,245 A * 10/1993 Collins ..... D01D 10/02 264/210.8 X
(Continued)

FOREIGN PATENT DOCUMENTS

JP 59168125 A * 9/1984 ..... D01F 9/14
JP 07189028 7/1995
(Continued)

OTHER PUBLICATIONS

International Search Report—PCT/KR2016/002368 dated Jun. 15, 2016.
(Continued)

*Primary Examiner* — Leo B Tentoni
(74) *Attorney, Agent, or Firm* — Cantor Colburn LLP

(57) ABSTRACT

Provided is a method of manufacturing high strength synthetic fibers, and high strength synthetic fibers manufactured using the same. More particularly, the method involves a localized heating process by raising the temperature of a
(Continued)

molten spinning fiber to a temperature higher than that of a pack body during a short period of time with no degradation through a heating zone located in the immediate vicinity of capillary in the spinning nozzle, so as to effectively control the molecular entanglement structure in the molten polymer without reducing the molecular weight and thus to enhance the drawability of the as-spun fibers, thereby improving the mechanical properties of the as-spun fibers, such as strength, elongation, etc., using the existing processes of melt spinning and drawing and thus enabling a mass production of a high-performance fiber at low cost.

11 Claims, 5 Drawing Sheets

(51) Int. Cl.

| | |
|---|---|
| ***D01D 5/253*** | (2006.01) |
| ***D01D 5/34*** | (2006.01) |
| ***D01D 5/36*** | (2006.01) |
| ***D01D 7/00*** | (2006.01) |
| ***D01D 10/02*** | (2006.01) |
| ***D01D 5/084*** | (2006.01) |
| ***D01D 5/088*** | (2006.01) |
| ***D01D 5/098*** | (2006.01) |
| ***D01D 5/30*** | (2006.01) |
| ***D01F 8/00*** | (2006.01) |
| ***D01F 8/14*** | (2006.01) |
| ***D01D 5/32*** | (2006.01) |
| ***D01F 6/06*** | (2006.01) |
| ***D01F 6/60*** | (2006.01) |
| ***D01F 6/62*** | (2006.01) |
| ***D01F 8/06*** | (2006.01) |
| ***D01F 8/12*** | (2006.01) |
| ***D01D 4/02*** | (2006.01) |
| *D01F 6/04* | (2006.01) |

(52) U.S. Cl.
CPC ..... *D01D 5/30* (2013.01); *D01D 5/32* (2013.01); *D01F 6/06* (2013.01); *D01F 6/60* (2013.01); *D01F 6/62* (2013.01); *D01F 8/00* (2013.01); *D01F 8/06* (2013.01); *D01F 8/12* (2013.01); *D01F 8/14* (2013.01); *D01F 6/04* (2013.01); *D10B 2401/063* (2013.01)

(58) Field of Classification Search
CPC .. D01D 5/32; D01D 5/34; D01D 5/36; D01D 7/00; D01D 10/02; D10B 2401/063
USPC ..... 264/172.12, 172.13, 172.14, 172.15, 264/172.17, 172.18, 177.13, 210.8, 264/211.12, 211.15, 211.17
See application file for complete search history.

(56) References Cited

U.S. PATENT DOCUMENTS

| | | | | | |
|---|---|---|---|---|---|
| 5,587,118 | A * | 12/1996 | Mallonee | D01D 5/253 | 264/172.13 |
| 5,688,458 | A * | 11/1997 | Koschinek | D01D 5/098 | 264/211.12 |
| 5,705,119 | A * | 1/1998 | Takeuchi | D01D 5/088 | 264/172.15 |
| 2001/0046583 | A1* | 11/2001 | Wilson | D01D 5/253 | 428/96 |

FOREIGN PATENT DOCUMENTS

| | | | |
|---|---|---|---|
| JP | 08026483 | | 3/1996 |
| JP | 3095942 | | 10/2000 |
| JP | 2012158851 | | 8/2012 |
| JP | 2012158851 | A * | 8/2012 |
| KR | 1020050090850 | | 9/2005 |

OTHER PUBLICATIONS

Ito, et al., Effects of sample geometry and draw conditions on the mechanical properties of drawn poly(ethylene terephthalate), Polymer, vol. 31, Jan. 1990, pp. 58-63.

Masuda, et al., Effect of the Control of Polymer Flow in the Vicinity of Spinning Nozzle on Mechanical Properties of Poly(ethylene terephthalate) Fibers, Intern. Polymer Processing XXV, 2010, pp. 159-169.

Sugimoto, et al., Melt Rheology of Polypropylene Containing Small Amounts of High-Molecular-Weight Chain. 2. Uniaxial and Biaxial Extensional Flow, Macromolecules, 2001, pp. 6056-6063.

Ziabicki, Effects of Molecular Weight on Melt Spinning and Mechanical Properties of High-Performance Poly(ethylene Terephthalate) Fibers, Textile Research Journal, 1996, pp. 705-712.

* cited by examiner

METHOD OF MANUFACTURING HIGH STRENGTH SYNTHETIC FIBERS

TECHNICAL FIELD

The present invention discloses a method of manufacturing high strength synthetic fibers, and high strength synthetic fibers manufactured using the same, which preparation method involves a localized heating process by raising the temperature of a molten fiber to a temperature higher than that of a pack body during a short period of time with no degradation through a heating zone in the immediate vicinity of the spinning nozzle, so as to effectively control the molecular entanglement structure in the molten polymer materials without reducing the molecular weight and thus to enhance the drawability (e.g., draw ratio) of the as-spun fibers, thereby improving the mechanical properties of the fibers, such as strength, elongation, etc., using the existing processes of melt spinning and drawing and thus enabling a mass production of a high-performance fiber at low cost.

BACKGROUND ART

For PET fibers commercially available, the highest strength so far is about 1.1 GPa and the empirical highest strength is no more than 3 to 4% of the theoretical highest strength, which is one third of the strength of other high strength fibers (e.g., ultimate-performance para-aramid (Kevlar) fiber having the strength of about 2.9 GPa). The use of the PET fibers as a fiber material is thus limited in the fields of industrial applications that require ultimate performance, other than general clothing or household or limited industrial (tire cords) applications.

Non-LC thermoplastic fibers, such as PET and nylon, display lower strength than LCP (Liquid Crystal Polymer) fibers, such as PBO (Zylon) or para-aramid (Kevlar) fibers, and their empirical strengths are impossible to increase dramatically with respect to the theoretical strengths. The reason lies in the difference of the structure-forming behavior while the resin is being processed into fiber.

Due to its liquid crystalline structure in the solution state, the LCP fiber has a small entropy difference in the fiber structure before and after the spinning process under appropriate shear stress and forms a fiber structure having a considerably high degree of orientation and crystallinity, so it can be made into high strength, high-performance fibers.

In contrast, the non-LC thermoplastic polymers like PET or nylon in molten state have a complicated structure with the polymer chains entangled in the form of amorphous random coils, so they are relatively hard to form with complete orientation and crystallization (i.e., high strength) due to their entangled structure in the form of random coils even if they are under a high shear stress in the spinning nozzle and stretched at an elongation ratio (draft and elongation ratio, etc.) out of the spinning nozzle. For this reason, there is a large entropy difference of the fiber structure before and after the spinning process.

Despite the structural demerits of general-purpose thermoplastic polymers, the PET fiber having a relatively high strength with respect to the existing fibers is expected to extend the market of its applications and to start an enormous ripple effect through the industry. In recent years, a variety of studies have been made in the Japanese textile industries to maximize the properties of the existing general-purpose PET fiber and to increase the critical performance of the fiber.

The subjects of the recent researches concerning the high strength PET fibers include, for example, the use of ultra-high molecular PET resins [Ziabicki, A., "Effect of Molecular weight on Melt Spinning and Mechanical Properties of High-Performance Poly(ethylene terephthalate) Fibers", Test. Res. J., 1996, 66, 705-712; Sugimoto, M., et al., "Melt Rheology of Polypropylene Containing Small Amounts of High-Molecular-Weight Chain. 2. Uniaxial and Biaxial Extensional Flow", Macromol., 2001, 34, 6045-6063] and the use of the coagulation bath technique in the melt spinning process to maximize the orientation [Ito M., et al., "Effect of Sample Geometry and Draw Conditions on the Mechanical Properties of Drawn Poly(ethylene terephthalate)", Polymer, 1990, 31, 58-63].

The above studies are to develop high strength PET fibers in a small-scaled laboratory, so no commercialization is allowed owing to the limitation in the workability and productivity with respect to the effect of the improvement of physical properties.

It has recently been reported that Japanese scientists are on the progress of research and development using general-purpose thermoplastic polymers like PET, nylon, etc. to increase the strength of the existing fibers from 1.1 GPa to 2 GPa within a range that does not raise the production cost more than twice in terms of the melt spinning process.

Furthermore, the ongoing research and development technologies in progress for the purpose of applying them for practical uses in the tire cords most consumed as an industrial fiber as soon as possible focus on the following technologies: molten structure control, molecular weight control, draw/heating, and evaluation/analysis.

Unlike the conventional technologies that realize fibers with high strength by the control of the fiber structure formation behavior through molecular orientation and crystallization of solidified fibers, the molten structure control technology in particular involves an approach to the control of the molecular entanglement structure in a molten polymer and focuses on the PET fibers having a high strength by studying the control of the structure and behavior in the non-oriented amorphous fibers.

There has been reported the development of high strength PET fiber through the design of spinning nozzles, laser heating, supercritical gas, coagulation bath, etc. as a means to control the molecular structure in the melt spinning process.

In particular, a conventional method of designing spinning nozzles used in the melt spinning process is adopted to produce high strength PET fibers through a localized heat-up process in the vicinity of the spinning nozzle. For examples, FIG. 7 shows an embodiment of a localized heating process performed right under the spinning nozzle, and FIG. 8 is a cross-sectional view of the embodiment of the localized heating process taken along the line III-III of FIG. 7.

More specifically, in the melt spinning process, a spinning nozzle 100 is fixed to a pack body 200 held by a pack-body heater 300 with a heat source of 100 to 350° C. After the spinning process, the multifilament passes through an annealing heater 400 having a thickness of 20 to 200 mm to maintain a constant distance from an electric heater having a temperature ranging from the room temperature to high temperature of 400° C., thereby achieving thermal transfer with high efficiency at a lower cost.

The localized heating on the fiber with the annealing heater 400 is not for heating the fiber but for warming the fiber to maintain the uniform temperature of the holes in the bottom of the spinning nozzle. Due to the minimization of the temperature variations of the holes, it is possible to improve the spinning workability and the product quality at once. But the distance between the fiber and the heater is too long, and a uniform heating is not applied to the fiber.

Another conventional method of performing a localized heating in the vicinity of the nozzle during the melt spinning process involves the irradiation of $CO_2$ laser beams right under the spinning nozzle with holes having a micro-sized diameter to prepare a high-performance PET fiber having strength of 1.68 Gpa (13.7 g/den) and elongation of 9.1% after drawing [Masuda, M., "Effect of the Control of Polymer Flow in the Vicinity of Spinning Nozzle on Mechanical Properties of Poly(ethylene terephthalate) Fibers", Intern. *Polymer Processing,* 2010, 25, 159-169].

In this regard, FIG. 9 is an embodiment of the localized heating by laser beams right under the spinning nozzle, and FIG. 10 is a cross-sectional view of the embodiment taken along the line IV-IV of FIG. 9.

More specifically, multifilament 112 are directly heated with $CO_2$ laser beams from a laser source 410 after the spinning process, with the bottom of a spinning nozzle 100 projecting to the bottom end of a pack body 200 to a length of 1 to 3 mm, and the $CO_2$ laser beams are irradiated from a distance of 1 to 10 mm immediately after the spinning process.

The laser heating process right under the spinning nozzle makes a specific portion of the fiber heated up to high temperature, but it is difficult to use for a commonly used spinning nozzle having dozens to tens of thousands of holes.

In an attempt to solve the problems with the conventional preparation method for high strength synthetic fiber, the inventors of the present invention have found out the fact that the optimization of the thermal transfer using a double heating method in the vicinity of capillary of a commonly-used spinning nozzle and right under the spinning nozzle can raise the temperature of the molten fiber higher than that of a pack body in a short period of time during which no degradation occurs, so as to effectively control the molecular entanglement structure in the polymer without reducing the molecular weight and to improve the mechanical properties of the synthetic fiber, such as strength, elongation, etc., thereby completing the present invention.

DISCLOSURE OF INVENTION

It is an object of the present invention to provide a method of manufacturing high strength synthetic fiber by optimizing an instantaneous localized heating method of a spinning nozzle during the spinning step in the melt spinning process.

It is another object of the present invention to provide a high strength synthetic fiber with improved strength and elongation according to the preparation method.

To achieve the objects of the present invention, there is provided a method of manufacturing high strength synthetic fiber that includes: melt-spinning a thermoplastic polymer materials 10 or 50 through a spinning nozzle containing at least one capillary to form molten fiber; passing the molten fiber through a heating zone 40 or 80 located in the immediate vicinity of the spinning nozzle 12 or 52 to heat the fiber; cooling down the heated fiber; and drawing the cooled fiber and then winding the drawn fiber, where the fiber is locally heated by passing through the heating zone 40 or 80 including a high-temperature heater (i.e., nozzle-heating mantles) 41 or 81 having a hole-type heating channel 41*a* or 81*a* or a band-type heating channel 41*b* or 81*b* formed on the periphery of the capillary of the spinning nozzle.

The preferred examples of the thermoplastic polymer materials comprises as used in the present invention may include any one selected from a polyester-based polymer selected from the group consisting of polyethylene terephthalate (PET), polybutylene terephthalate (PBT), polytrimethylene terephthalate (PTT), polycyclohexane dimethanol terephthalate (PCT), and polyethylene naphthalate (PEN); a polyamide-based polymer selected from the group consisting of nylon 6, nylon 6,6, nylon 4, and nylon 4,6; or a polyolefin-based polymer selected from the group consisting of polyethylene and polypropylene.

In the preparation method, the molten fiber passes through the high-temperature heater 41 or 81 maintained under heat-up conditions to a temperature higher than that of pack body 20 or 60, respectively. The high-temperature heater 41 or 81 has a temperature difference of 0 to 1,500° C. from the pack body 20 or 60. Further, the pack body 20 or 60 is maintained at temperature of 50 to 400° C.

The fiber passes through a high-temperature heater 41 or 81 provided in the form of a plurality of a hole-type heating channel 41*a* or 81*a* having holes apart from the center of each capillary of the spinning nozzle at a distance of 1 to 300 mm. At this point, the hole-type heating channel 41*a* or 81*a* can maintain a uniform temperature at a same distance from the center of each capillary of the spinning nozzle in the 360-degree directions.

The fiber passes through a high-temperature heater 41 or 81 provided in the form of a plurality of a band-type heating channel 41*b* or 81*b* formed in an arrangement disposed between adjacent capillaries, when the plurality of the capillary are arranged in a same radius from the center of the spinning nozzle. In the band-type heating channel 41*b* or 81*b*, the heaters are opposite to each other (180-degree mirrored) and arranged in a symmetric manner at distance of 1 to 300 mm from the middle of the capillary of the spinning nozzle.

In the heating zone 40 according to the first preferred embodiment of the present invention, an insulator 43 has a thickness of 1 to 30 mm in the immediate vicinity of capillary in the spinning nozzle, and the high-temperature heater 41 extends to a length of 1 to 500 mm from the insulator. The heating zone for the fiber is defined to include the thickness of the insulator and the extension length of the high-temperature heater. Therefore, the not-yet-solidified molten thermoplastic polymer material 10 or 50 immediately after the spinning process is indirectly heated up (e.g., radiation).

In the heating zone 80 according to the second preferred embodiment of the present invention, a high-temperature heater 81 is in contact with or partly inserted into the bottom of a spinning nozzle 52, and the bottom of the spinning nozzle 52 is positioned at a distance of −50 mm (inside the pack body) to 300 mm (outside the pack body) from the bottom of the pack body. More specifically, the high-temperature heater 81 is inserted into the bottom of the spinning nozzle 52 to an insertion length of 0 to 50 mm and extends from the bottom of the spinning nozzle 52 to an extension length of 0 to 500 mm. Hence, the heating zone 80 for the fiber is defined to include the insertion length of the high-temperature heater into the bottom of the spinning nozzle and the extension length of the high-temperature heater from the bottom of the spinning nozzle.

Through the heating zone 80 of the second embodiment, a first heating process is applied to the molten polymer in the capillary of the spinning nozzle before being spinning in a direct way (e.g., heat transfer). Then, a second heating process is applied to the not-yet-solidified, molten polymer extruded from the nozzle after the spinning process in an indirect way (e.g., radiation) through the extending high-temperature heater.

In the second embodiment, the heating zone is designed to have a structure projecting to a length of −50 mm (inserted into the pack body) to 300 mm (coming out of the pack body) from the bottom of the pack body, in order to prevent deterioration of the molten polymer in the capillaries 11 or 51 of the spinning nozzle 12 or 52 caused by the transfer of a high temperature heat to the nozzles during a direct/indirect heating process in the vicinity of the capillary on the bottom of the spinning nozzles.

At this point, the thermoplastic polymer passing through each capillary of the spinning nozzle has a residence time of 3 seconds or less and a throughput rate of at least 0.01 cc/min, with the shear rate on the wall surface of the capillary in the spinning nozzle being optimized to 500 to 500,000/sec.

The capillary 11 or 51 of the spinning nozzle 12 or 52 has a structure with a diameter (D) of 0.01 to 5 mm, a length (L) of L/D 1 or greater, a pitch of 1 mm or greater, and a cross-section taking a circular shape or a noncircular shape.

The spinning nozzle used in the preparation method for high strength synthetic fiber is a nozzle for at least one single or conjugated spinning method selected from the group consisting of sheath-core type, side-by-side type, and islands in the sea type.

The present invention further provides a high strength synthetic fiber with enhanced mechanical properties, such as tensile strength and elongation, according to the novel preparation method for synthetic fiber.

More specifically, the preparation method for synthetic fiber according to the present invention includes heating up a thermoplastic polymer to a temperature higher than that of the pack body by an instantaneous localized heating process at high temperature in the immediate vicinity of the nozzle during the melt spinning process and then performing cooling and drawing processes to produce high strength PET, nylon, or PP fibers having maintained intrinsic viscosity and improved strength and elongation without causing degradation of the polymer even under the high-temperature localized heat-up conditions.

EFFECTS OF THE INVENTION

The method of manufacturing high strength synthetic fiber according to the present invention is optimizing the heating method for the polymer during spinning in the melt-spinning process at position located in the immediate vicinity of the spinning nozzle. More specifically, it includes heating process to the not-yet-solidified, molten thermoplastic polymer in the immediate vicinity of the commonly used spinning nozzle to optimize the heat transfer, thereby locally heating the molten spinning fiber to a temperature higher than that of the pack body during a short period of time without degradation and enhancing the drawability of the fiber through an effective control of the molecular entanglement structure in the polymer without reduction of the molecular weight to improve the mechanical properties of the fiber, such as strength, elongation, etc.

Accordingly, the method of manufacturing high strength synthetic fiber according to the present invention uses the existing processes of melt spinning and drawing and improves the mechanical properties to reduce the initial investment cost and to enable the mass production of high performance fibers at a low cost.

With the competitive price due to the mass production and the low cost and the control of various properties of fibers, the present invention is available to a variety of applications, including interior materials of transportation, such as tire cord, automobile, train, airplane, ship, etc., civil engineering and construction materials, electronic materials, and marine and military applications, such as rope, net, etc., and furthermore, clothing and household applications, such as lightweight sportswear, working clothes, military uniforms, etc., and furniture, interiors, and sporting goods, thereby securing extensive markets.

The present invention may also be applicable to the textile applications, such as long fiber, short fiber, nonwoven fabric, etc. and possibly extendable to the manufacture of films, sheets, molded products, containers, etc. using those textile materials.

BRIEF DESCRIPTIONS OF DRAWINGS

BEST MODES FOR CARRYING OUT THE INVENTION

Figure 1:
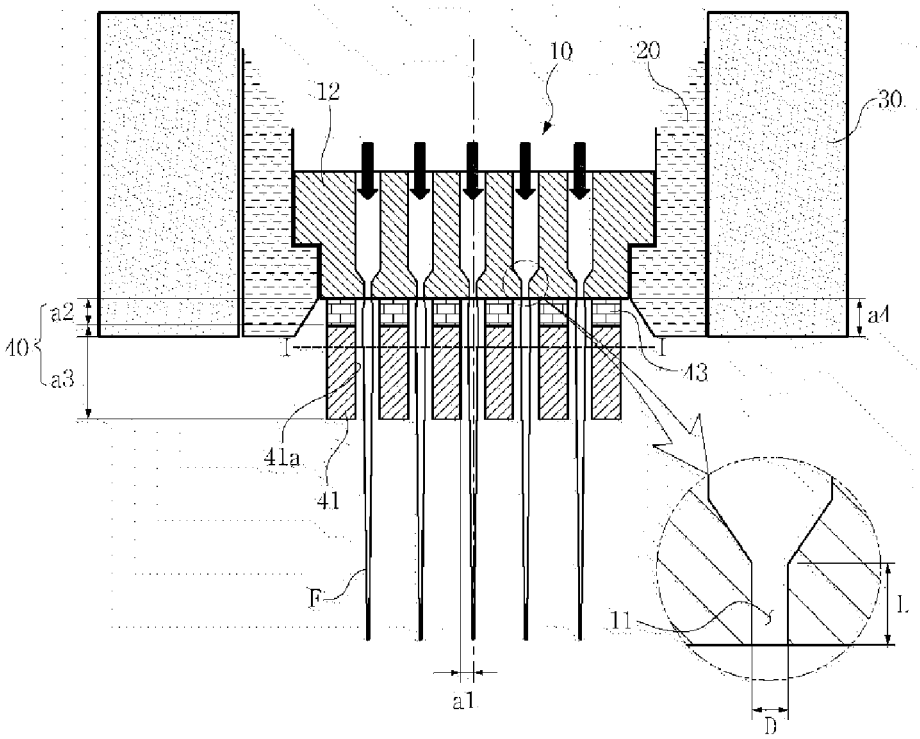
FIG. 1 is an enlarged view of a spinning nozzle having a heating zone according to a first embodiment of the present invention.

Hereinafter, the present invention will be described in further detail as follows.

The present invention provides a method of manufacturing high strength synthetic fiber that includes: melt-spinning a thermoplastic polymer through a spinning nozzle comprising at least one capillary to form molten fiber; passing the molten fiber through heating zones 40 or 80 located in the immediate vicinity of the spinning nozzles 12 or 52 during the spinning step to heat the fiber; cooling down the heated fiber; and drawing the cooled solidified fiber and then winding the drawn fiber, where the fiber is locally heated by passing through the heating zone 40 or 80 including a high-temperature heater (i.e., nozzle-heating mantles) 41 or 81 having a hole-type heating channel 41*a* or 81*a* or a band-type heating channel formed on the periphery of the capillary of the spinning nozzle.

In the preparation method of the present invention, the polymer material as used herein may be any one of the general-purpose thermoplastic polymers without limitation. Preferably, the polymer material may be any one selected from a polyester-based polymer selected from the group consisting of polyethylene terephthalate (PET), polybutylene terephthalate (PBT), polytrimethylene terephthalate (PTT), polycyclohexane dimethanol terephthalate (PCT), and polyethylene naphthalate (PEN); a polyamide-based polymer selected from the group consisting of nylon 6, nylon 6,6, nylon 4, and nylon 4,6; or a polyolefin-based polymer selected from the group consisting of polyethylene and polypropylene.

In the embodiment of the present invention, the preferred examples of the thermoplastic polymer may include, but are not specifically limited to, polyethylene terephthalate (PET), nylon 6, and polypropylene.

During the spinning step, the fiber F passes through heating zones 40 or 80 arranged in the immediate vicinity of the spinning nozzles 12 or 52. In order to avoid a direct thermal contact (heat transfer) with (to) the spinning nozzles, the fiber F passes through high-temperature heater 41 or 81 provided in the form of a hole-type heating channel 41*a* or 81*a* or a band-type heating channel 41*b* or 81*b* on the periphery of capillaries.

Figure 2:
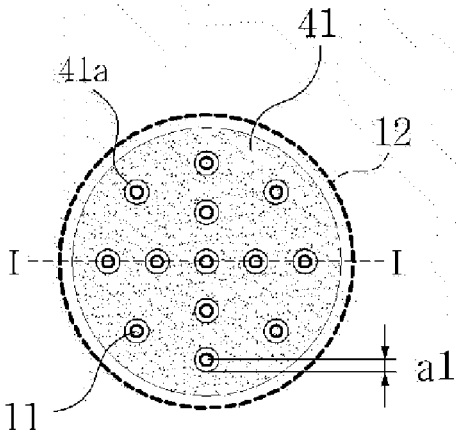
FIG. 2 is a cross-sectional view taken along the line I-I of FIG. 1.

Hereinafter, the present invention will be described with reference to the accompanying drawings. FIG. 1 is an enlarged view of a spinning nozzle having a heating zone according to a first embodiment of the present invention, and FIG. 2 is a cross-sectional view taken along the line I-I of FIG. 1, where a spinning nozzle 12 is installed in a pack body 20 of a spinning device, with a pack-body heater 30 mounted on the exterior side of the pack body 20. The spinning nozzle 12 having a plurality of capillary 11 for melt-spinning a thermoplastic resin to form a fiber F; and a heating unit provided under the capillary 11 of the spinning nozzle 12 to heat up the fiber F after the spinning step.

The spinning nozzle 12 extrudes the molten thermoplastic resin through the capillary 11 to form a fiber F. The fiber F is heated by passing through the heating unit after the spinning step and then cooled down. The cooled fiber F is drawn by an in-line drawing machine and then wound into a thermoplastic polymer fiber.

In this regard, the heating unit provided in the immediate vicinity of the spinning nozzle 12 is comprised of high-temperature heater 41 having a hole-type heating channel 41*a* of which the structure and the number are the same as those of the capillary 11 of the spinning nozzle 12. The fiber F is to pass through each heating channel 41*a* after the spinning step, but not in direct contact (e.g., thermal transfer) with the heating unit 41*a* while passing through the heating channel 41*a*.

For this, the distance "a1" from the inner circumference of the heating channel 41*a* to the core of the fiber F is preferably 1 to 300 mm, more preferably 1 to 100 mm. The hole-type heating channel 41*a* can maintain a uniform temperature at a same distance from its center in the 360-degree directions.

Figure 3:
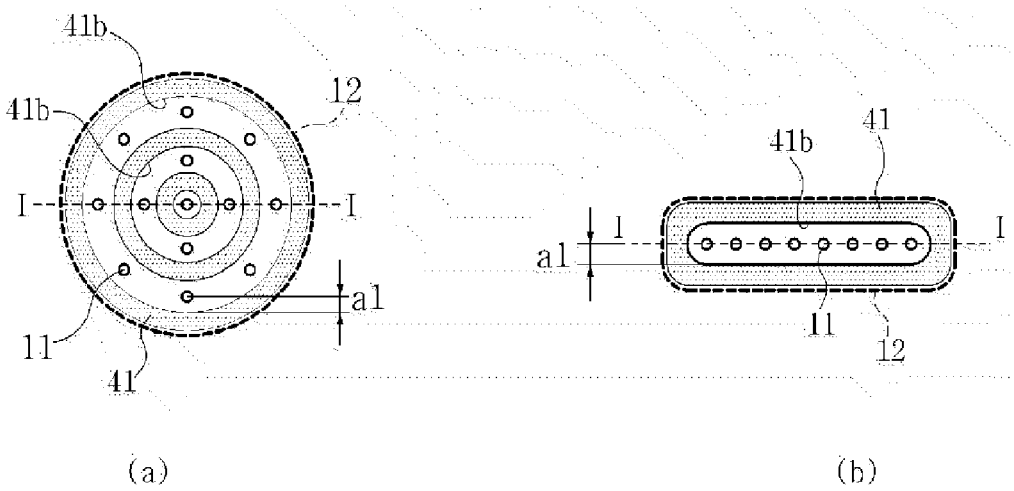
FIG. 3 is cross-sectional views taken along the line I-I of FIG. 1 showing variations of the first embodiment.

In a modification of the heating channel 41*a*, where the spinning nozzle has a plurality of capillary 11 arranged in concentric circles as shown in (a) of FIG. 3, the heating channel 41*b* may be provided in the form of a circular band so that the fiber F spun from a plurality of the capillary 11 arranged in concentric circles can pass through the heating channel 41*b* at the same time. In another modification of the heating channel 41*a*, where the spinning nozzle has a plurality of capillary 11 arranged in a linear manner as shown in (b) of FIG. 3, the heating channel 41*b* may be provided in the form of a linear band so that the fiber F spun from a plurality of the capillary 11 linearly arranged can pass through the heating channel 41*b*. Otherwise, if not shown, the heating channel may be designed in various forms containing a circular according to the arrangement of the capillary 11 of the spinning nozzle 12*a*, or in combination of various hole forms.

Like the hole-type heating channel 41*a*, the band-type heating channel 41*b* is designed so that the distance "a1" from the inner circumference of the heating channel 41*b* to the core of the fiber F is preferably 1 to 300 mm, more preferably 1 to 100 mm.

Referring to FIG. 1 again, it is desirable that there is no thermal transfer between the spinning nozzle 12 and the high-temperature heater 41. For this, an insulator 43 is provided between the spinning nozzle 12 and the high-temperature heater 41.

The temperature of the spinning nozzle 12 is equal to that of the pack-body heater 30. The insulator 43 functions to prevent the transfer of a high temperature heat from the high-temperature heater 41 positioned on the immediate vicinity of the spinning nozzle 12 to the spinning nozzle 12 and thereby prevents the deterioration of the material comprised of a thermoplastic resin, such as polyester-based polymer resins, and hence the deterioration of the properties of the fiber. The material for the insulator 43 as used herein may be a known adiabatic material that has a thermal insulating effect, preferably an inorganic material having a fire resistance at high temperature, including glass and ceramic compounds.

The thickness "a2" of the insulator 43 is defined so that the distance between the spinning nozzle 12 and the high-temperature heater 41 is 1 to 30 mm. When the thickness "a2" is greater than 30 mm, for example, the fiber F formed after the spinning from the spinning nozzle 12 gets cooled down prior to being heated with the high-temperature heater 41, making it hard to control the melt structure with efficiency.

The extension length "a3" of the high-temperature heater 41 is defined in the range of 1 to 500 mm from its junction with the insulator 43. The coverage including the thickness "a2" of the insulator 43 and the extension length "a3" of the high-temperature heater 41 forms a heating zone 40.

Namely, the heating zone 40 of the first embodiment of the present invention is defined to realize an indirect heating (e.g., radiation) on the fiber F after the spinning step while the fiber F is passing through the high-temperature heater 41 that has the coverage including the thickness "a2" of the insulator 43 defined as 1 to 30 mm located in the immediate vicinity of the spinning nozzle 12 and the extension length "a3" of 1 to 500 mm from the insulator 43.

In this regard, the distance "a4" from the bottom of the spinning nozzle 12 to the bottom side of the pack body 20 is in the range of 1 to 30 mm, so the whole insulator 43 and a part of the high-temperature heater 41 in the heating zone 40 are positioned in the pack body 20. This allows an indirect (e.g., radiation) heating on the whole of the fiber F immediately after the spinning step to enhance the productivity.

The designed heating zone 40 including the high-temperature heater 41 and the insulator 43 as illustrated in the first embodiment of the present invention is directly applicable the commonly used spinning nozzle 12 without an alteration of the design, thus reducing the initial investment cost and increasing the productivity of the fiber at a low cost.

Further, the heating zone 40 of the first embodiment allows an instantaneous heating on the whole fiber F extruded after the spinning step under uniform high-temperature conditions from a constant distance, so it is possible to control the molecular entanglement structure in the molten polymer and to prevent the transfer of a high temperature heat to the capillary 11 of the spinning nozzle 12 through the insulator 43, thereby avoiding poor properties caused by the degradation of the molten polymer. Accordingly, the heating zone 40 of the first embodiment to form a fiber F may be preferably applicable to any typical thermoplastic resin without limitation, more preferably to polymer resins susceptible to heat.

Figure 4:
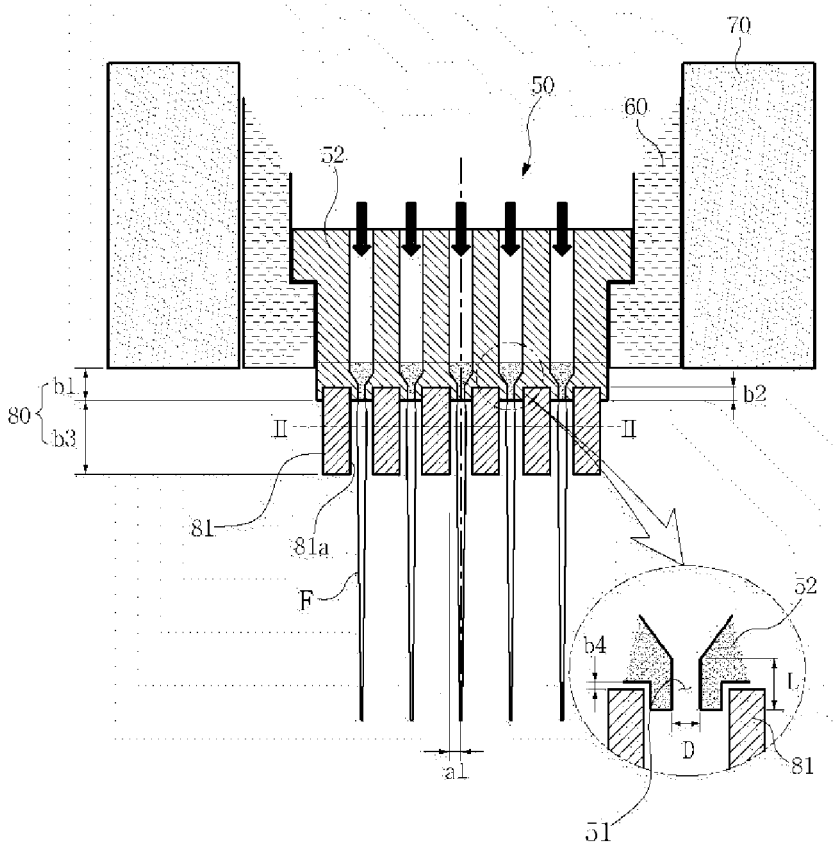
FIG. 4 is an enlarged view of a spinning nozzle having a heating zone according to a second embodiment of the present invention.
Figure 5:
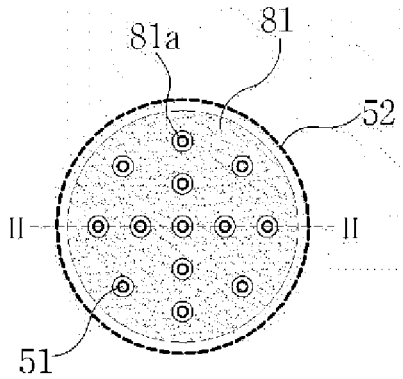
FIG. 5 is a cross-sectional view taken along the line II-II of FIG. 4.

FIG. 4 is an enlarged view of a spinning nozzle having a heating zone according to a second preferred embodiment of the present invention, and FIG. 5 is a cross-sectional view taken along the line II-II of FIG. 4, where a spinning nozzle 52 according to the second embodiment is installed in a pack body 60 of a spinning device, with a pack-body heater 70 mounted on the exterior side of the pack body 60.

The spinning nozzle 52 includes a plurality of capillary 51 for melt-spinning a thermoplastic resin to form a fiber F; and a heating unit provided under the capillary 51 of the spinning nozzle 52 to heat up the fiber F after the spinning step.

Figure 6:
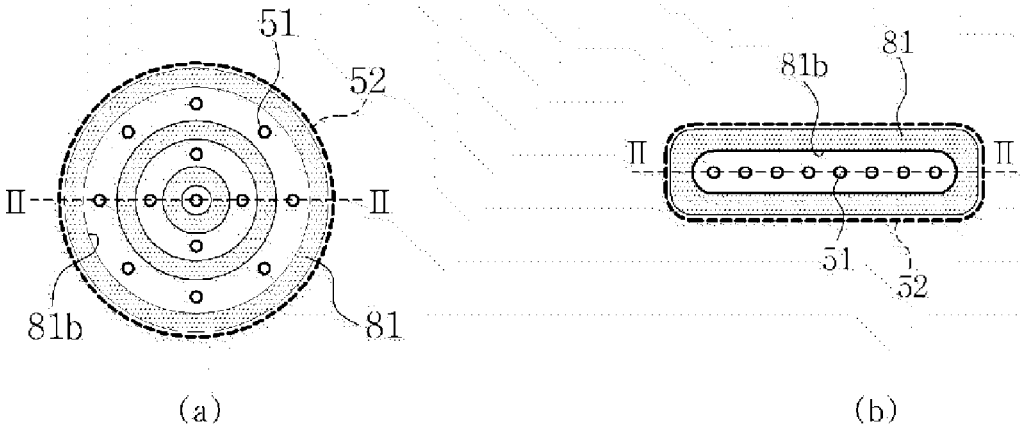
FIG. 6 is cross-sectional views taken along the line II-II of FIG. 4 showing variations of the second embodiment.
Figure 7:
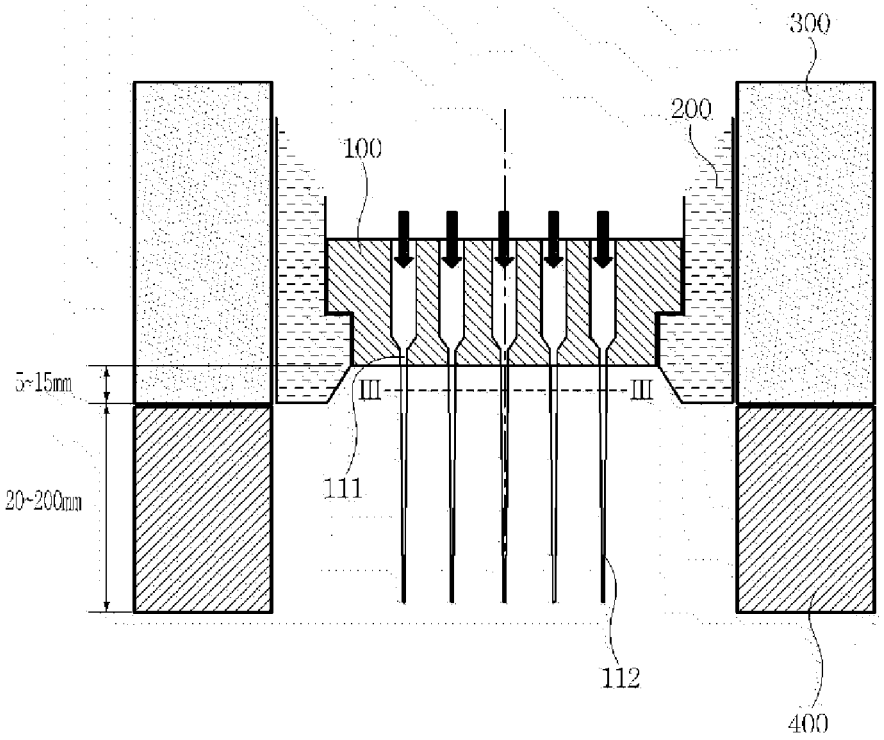
Fig. 7 Prior Art
FIG. 7 is an enlarged view of the spinning unit equipped with a spinning nozzle according to a conventional example.
Figure 8:
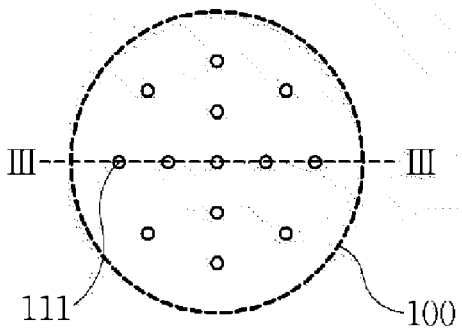
Fig. 8 Prior Art
FIG. 8 is a cross-sectional view taken along the line III-III of FIG. 7.
Figure 9:
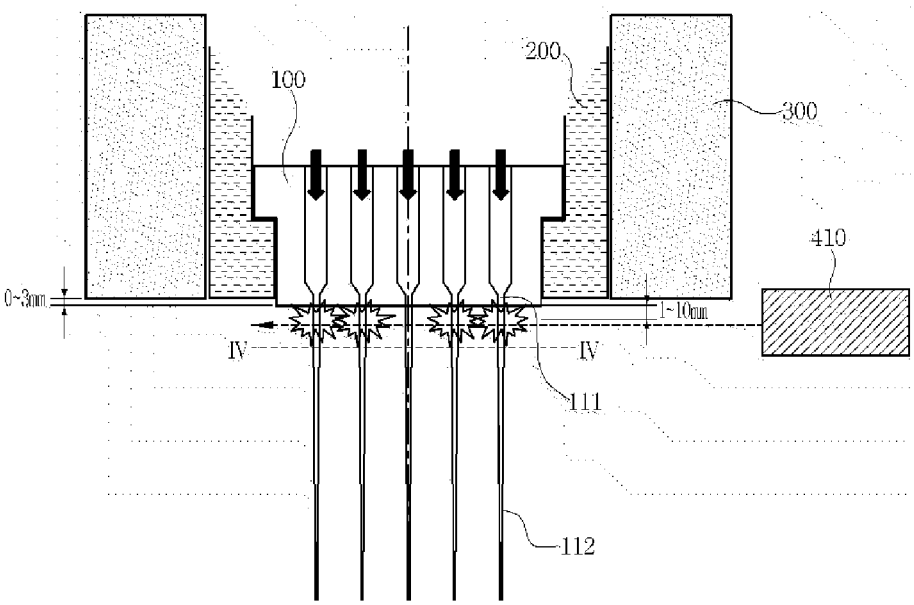
Fig. 9 Prior Art
FIG. 9 is an enlarged view of the spinning unit equipped with a spinning nozzle according to another conventional example.
Figure 10:
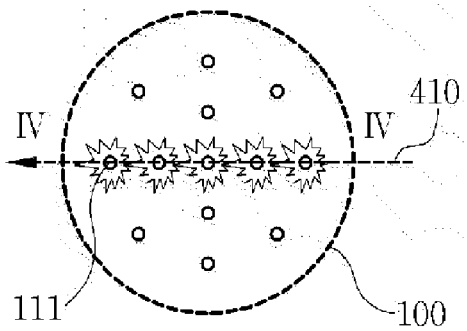
Fig. 10 Prior Art
FIG. 10 is a cross-sectional view taken along the line IV-IV of FIG. 9.

The heating unit according to the second embodiment is comprised of a high-temperature heater 81 having an hole-type heating channel 81*a* of which the structure and the number are the same as those of the capillary 51 of the spinning nozzle 52, or having a band-type heating channel 81*b* as shown in (a) and (b) of FIG. 6. The fiber F is to pass through each heating channel 81*a* or 81*b* after the spinning step, but not in direct contact (e.g., thermal transfer) with the heating channel 81*a* or 81*b* while passing through the heating channel 81*a* or 81*b*.

The heating channel 81*a* or 81*b* is all the same as the heating channel 41*a* or 41*b* described in the first embodiment, and a detailed description of the specific construction will be omitted.

Referring to FIG. 4 again, the heating unit according to the second embodiment is comprised of a high-temperature heater 81 that is in contact with the bottom surface of the spinning nozzle 52 or inserted into the bottom of the spinning nozzle 52 as deep as an insertion length "b2" of 0 to 50 mm and extending from the bottom surface of the spinning nozzle 52 to an extension length "b3" of 0 to 500 mm, where the bottom of the spinning nozzle 52 is positioned at a distance (length) "b1" of −50 mm (inside the pack) to 300 mm (outside the pack) from the bottom of the pack body 60 without an insulator in the immediate vicinity of the spinning nozzle 52. Here, a heating zone 80 is defined to include the insertion length "b2" of the high-temperature heater 81 into the spinning nozzle 52 and the extension length "b3" of the high-temperature heater 81 extending from the bottom surface of the spinning nozzle 52.

As illustrated in the partial enlarged view of FIG. 4, a gap "b4" of 0 to 10 mm is formed between the top of the high-temperature heater 81 inserted into the spinning nozzle 52 and the opposing bottom surface of the spinning nozzle 52. In this manner, the high-temperature heater 81 is in direct contact with the surface of the spinning nozzle 52 (when b4 is 0 mm) or apart from the surface of the spinning nozzle 52 (when b4 is at most 10 mm) to incur a direct or indirect heating (e.g., heat transfer or radiation) on the spinning nozzle 52, so a direct heating (e.g., heat transfer) is firstly imposed on the molted thermoplastic resin in the capillary 51 in the spinning nozzle 52.

Therefore, the heating zone 80 is designed to provide a first heating (direct/indirect) (e.g., heat transfer or radiation) for the molten thermoplastic resin in the vicinity of the capillary 51 in the spinning nozzle 52 before the spinning step through the gap "b4" and the insertion length "b2" of the high-temperature heater 81 inserted into the bottom of the spinning nozzle 52, and then a second heating (indirect) (e.g., radiation) for the not-yet-solidified molten fiber F extruded from the spinning nozzle 52 after the spinning step through the extension length "b3" of the high-temperature heater 81 extending as long as 0 to 500 mm.

The heating zone 80 of the second embodiment optimizes the thermal transfer into a double heating method due to the structural modification of the bottom of the commonly used spinning nozzle 52, where the double heating method involves directly transferring a high temperature heat to the vicinity of the capillary 51 of the spinning nozzle 52 and indirectly heating the fiber F with the high-temperature heater 81 formed in the immediate vicinity of the spinning nozzle 52. Using the double heating method, the molecular entanglement structure in the molten polymer can be controlled by an instantaneous high-temperature heating to enhance the drawability of the obtained thermoplastic polymer fiber and to lower the cooling rate, resulting in increasing the spinning rate and the drawing rate and thus improving productivity.

Accordingly, the second embodiment is directly applicable by varying the bottom structure of the commonly used spinning nozzle 52, to reduce the initial investment cost and to enhance the productivity of the synthetic fiber at a low cost.

In order to achieve the same object, it is necessary to optimize the residence time, throughput rate, and shear rate of the molten polymer passing through the capillaries 11 and 51 of the nozzle bodies 12 and 52, respectively, in the heating units of the first and second embodiments.

Preferably, the residence time of the molten polymer per capillary is 3 seconds or less, and the throughput rate is at least 0.01 cc/min. When the residence time exceeds 3 seconds in the case of a polyester polymer, the molten polymer is exposed to excess heat for a long time to incur degradation. When the throughput rate is less than 0.01 cc/min for a polyester polymer, it leads to the same problem, that is, having the molten polymer exposed to excess heat to cause degradation.

In the nozzle bodies 12 and 52 of the first and second embodiments, the shear rate on the wall surface of the capillary 11 or 51 is preferably 500 to 500,000/sec. When the shear rate is less than 500/sec, the effects of molecular orientation and structure control of the molten polymer are reduced due to a low shear stress. When the shear rate is greater than 500,000/sec, the viscoelasticity of the molten polymer causes melt fractures to form the non-uniform cross-section of the fiber.

In other words, the structures characteristic to the present invention, the heating channels 41*a*, 41*b*, 81*a*, and 81*b* of the high-temperature heater 41 or 81, are the same in the structure and number as the capillaries 11 and 51 of the nozzle bodies 12 and 52, respectively, so the fiber F extruded after the spinning step can be locally heated while passing through the high-temperature heater 41 or 81. Particularly, the hole-type heating channels 41*a* and 81*a* maintain the structures of the capillaries 11 and 51 of the spinning nozzles 12 and 52, respectively, with their inner circumferences are formed apart from the center of the capillaries 11 and 51 of the nozzle bodies 12 and 52 at distance of 1 to 300 mm, respectively. This helps maintain a uniform temperature at a same distance from the center of the capillary 11 or 51 of the spinning nozzle 12 or 52 in the 360-degree directions [Refer to FIGS. 2 and 5].

In addition, the band-type heating channel 41*b* or 81*b* has a linear structure with the capillary 11 or 51 of the spinning nozzle 12 or 52 forming the line dividing it into two opposite parts. It is formed at distance of 1 to 300 mm from the middle line of the capillary 11 or 51 and symmetric along the middle line of the capillary 11 or 51 [Refer to FIGS. 3 and 6].

In this regard, the heating channels 41*a*, 41*b*, 81*a*, and 81*b* are designed to realize an indirect heating method that the fiber F passing through them after the spinning step do not in direct contact with a heater. When the heating channels 41*a*, 41*b*, 81*a*, or 81*b* has such a dimension that the distance from the middle line of the capillary 11 or 51 of the spinning nozzle 12 or 52 is less than 1 mm, the high-temperature heater 41 or 81 is highly likely to contact the fiber F. This results in the contamination of the high-temperature heater 41 or 81 and the breaks of the fiber F so as to lower the quality of the fiber and the workability and also incurs the risk of deteriorating the fiber F under excess heat. When the distance is greater than 300 mm, it is difficult to control the molecular entanglement structure in the molten polymer fiber due to the insufficient thermal transfer to the fiber F, undesirably reducing the effect of improving the properties.

Regarding the structure of the capillary 11 or 51 of the spinning nozzle 12 or 52, as shown in FIG. 2 or 5, the capillary diameter D is 0.01 to 5 mm, the capillary length L is at least L/D 1, and the number of the capillary 11 or 51 in the spinning nozzle is at least one.

The pitch between the capillaries 11 and 51 is at least 1 mm. The cross-section of the capillary 11 or 51 is circular in the embodiments of the present invention, but may also be of a variant shape (e.g., Y, +, −, O, etc.). Besides, the spinning nozzle unit including the spinning nozzles 10 and 50 can be used to enable at least two types of conjugated spinning, such as sheath-core type, side-by-side type, and islands in the sea type, etc.

As the hole-type heating channels 41*a* and 81*a* of the high-temperature heater 41 or 81 is the same in the structure and number as the capillaries 11 and 51 of the spinning nozzles 12 and 52, respectively, they have an channel structure including any shape of circle, oval, rectangle, donut, etc.

Further, the high-temperature heater 41 or 81 may use any typical electric heat ray, which may be provided by any one selected from the group consisting of Cu- or Au-based cast heater, electromagnetic induction heater, sheath heater, flange heater, cartridge heater, coil heater, near-infrared heater, carbon heater, ceramic heater, PTC heater, quartz tube heater, halogen heater, nichrome wire heater, etc.

In the first and second preferred embodiments of the spinning nozzle for preparation of high strength thermoplastic fiber according to the present invention, the high-temperature heater 41 or 81 has a temperature difference of 0 to 1,500° C. from the pack bodies 20 and 60 and hence provides heat of which the temperature is at least equal to or higher than that of the pack bodies 20 and 60.

The nozzle bodies 12 and 52 are fixed to the pack bodies 20 and 60 maintained at temperatures of 50 to 400° C. by the heat source of the pack-body heaters 30 and 70, respectively. Hence, the temperature of the nozzle bodies 12 and 52 is equal to or higher than that of the pack-body heaters 30 and 70, respectively. When the temperature of the pack bodies 20 and 60 is lower than 50° C., the resin mostly fails to melt and gets too hard to spin. When the temperature of the pack bodies 20 and 60 exceeds 400° C., a rapid degradation of the resin occurs undesirably to deteriorate the properties of the fiber.

At this point, the temperature of the pack bodies 20 and 60 may be regulated with an electric heater or a heat transfer medium.

Subsequently, the molten polyester polymer is spun through a spinning nozzle unit including a spinning nozzle to form an extruded fiber. The embodiment of the present invention suggests the most preferred examples of the polymer material that may include, but are not specifically limited to, PET, nylon, and PP fibers. The polymer material of the present invention may also be applicable to the textile applications, such as long fiber, short fiber, unwoven fabric, etc. and possibly extendable to the manufacture of films, sheets, molded products, containers, etc.

The spinning nozzles 10 and 50 of the first and second embodiments may be applied to a melt spinning process using at least one thermoplastic polymer as a raw material. More specifically, they may be applied to a single or conjugated spinning process for monofilament that is carried out at a spinning rate of 01 to 200 m/min to produce monofilaments having a diameter of 0.01 to 3 mm.

Further, the localized heating method performed in the immediate vicinity of the spinning nozzles in the conjugated melt spinning process is applicable to a single or conjugated spinning process for multifilament (long fiber) having a diameter of 100 d/f or less using the low-speed spinning method (UDY (undrawn yarn), 100 to 2,000 m/min), the middle-speed spinning method (POY (partially oriented yarn), 2,000 to 4,000 m/min), the high-speed spinning method (HOY (highly oriented yarn), 4,000 m/min or higher), and the spin and in-line draw method (SDY).

Besides, it is also applicable to a single or conjugated spinning process for staple fiber (short fiber) at a spinning rate of 100 to 3,000 m/min to produce a fiber having a diameter of 100 d/f or less, or to a single and conjugated spinning process for nonwoven fabrics (e.g., spun-bound, melt blown, etc.) at a spinning rate of 100 to 6,000 m/min to form a fiber having a diameter of 100 d/f or less. It is further applicable to the molding and extrusion process of polymer resins.

The preparation method for high strength synthetic fiber according to the present invention that optimizes the method of heating in the immediate vicinity of the spinning nozzle during the melt spinning process can improve the properties of the fiber by utilizing a commonly used design of the spinning nozzle and the existing melt-spinning and drawing processes, thereby reducing the initial investment cost and enabling the production of high performance fibers on a large scale at a low cost.

Accordingly, the present invention provides a high strength synthetic fiber with maintained intrinsic viscosity and improved strength and elongation without the reduction of the molecular weight even under high temperature heat by using a thermoplastic polymer as a raw material and applying a localized heating in the melt spinning process through a heating zone arranged to the immediate vicinity of the spinning nozzle to raise the temperature of the molten fiber to a high temperature higher than the temperature of the pack body in a short period of time during which no degradation of the molten polymer occurs.

The present invention also enables the production of a high strength PET fiber having a strength of 11 g/d or greater by the above-described preparation method.

Particularly, the present invention provides a high strength PET fiber having an elongation of 5% or higher and satisfying the properties equivalent to or greater than the strength calculated from the following Equation 1, which high strength PET fiber is prepared by applying an instantaneous localized heating at high temperature in the immediate vicinity of capillary in the spinning nozzle during the melt spinning step to heat up a PET (polyethylene terephthalate) polymer having an intrinsic viscosity (Iv value) of 0.5 to 3.0, more preferably 0.5 to 1.5 and then performing the subsequent spinning, drawing and cooling steps [Refer to Tables 1 and 2].

Tensile strength (g/d)=15.873×intrinsic viscosity (Iv) of PET fiber−3.841 [Equation 1]

According to the measurement method for the intrinsic viscosity (Iv) of the PET fiber, 0.1 g of a sample is dissolved in a reagent prepared by mixing phenol and 1,1,2,2-tetrachloroethanol at a mixing ratio (weight) of 6:4 for 90 minutes to a concentration of 0.4 g/100 ml, and the resultant solution is introduced into an Ubbelohde type viscometer and maintained at 30° C. in a temperature-controlled liquid bath for 10 minutes, after which the drop time in seconds of the solution is determined using the viscometer and an aspirator. The drop time in seconds of the solvent is also measured in the same manner as described above to determine the Rv value and to calculate the Iv value according to the flowing equation (Billmeyer approximation equation).

Rv value=the drop time of sample/the drop time of solvent

Iv value=(Rv value−1)/4$C$+3 ln(Rv value)/4$C$ (C is the concentration (g/100 ml)).

Accordingly, the instantaneous localized heating method of applying a localized heating at high temperature in the immediate vicinity of capillary in the spinning nozzle during the melt spinning process in the present invention can be used to produce high strength polyester fibers with relatively high properties unattainable from the intrinsic viscosity (Iv) of the existing fibers, using a group of polyester fibers with different values of intrinsic viscosity (Iv).

Further, the present invention can prepare a high strength nylon fiber having a strength of 10.5 g/d or greater according to the above-described preparation method.

Particularly, the present invention provides a high strength nylon fiber having an elongation of 5% or higher and satisfying the properties equivalent to or greater than the strength calculated from the following Equation 2, which high strength nylon fiber is prepared by applying an instantaneous localized heating at high temperature in the immediate vicinity of capillary in the spinning nozzle during the melt spinning step to heat up a nylon polymer having a relative viscosity (Rv) of 2.0 to 5.0, more preferably 2.5 to 3.5 and then performing the subsequent spinning, drawing and cooling steps [Refer to Table 3].

Tensile strength (g/d)=8.6×Relative viscosity (Rv) of nylon fiber−14.44 [Equation 2]

According to the measurement method for the relative viscosity (Rv) of the nylon fiber, 0.1 g of a sample is dissolved in a 96% sulfuric acid for 90 minutes to a concentration of 0.4 g/100 ml, and the resultant solution is introduced into an Ubbelohde type viscometer and maintained at 30° C. in a temperature-controlled liquid bath for 10 minutes, after which the drop time in seconds of the solution is determined using the viscometer and an aspirator. The drop time in seconds of the solvent is also measured in the same manner as described above to determine the Rv value according to the flowing equation.

Rv value=the drop time of sample/the drop time of solvent

Accordingly, the instantaneous localized heating method of applying a localized heating at high temperature in the immediate vicinity of the nozzle during the melt spinning process in the present invention can be used to produce high strength polyamide fibers with relatively high properties unattainable from the relative viscosity (Rv) of the existing fibers, using a group of polyamide fibers with different values of relative viscosity (Rv).

Furthermore, the present invention can prepare a high strength PP fiber having a strength of 10.0 g/d or higher according to the above-described preparation method.

Particularly, the present invention provides a high strength PP fiber having an elongation of 5% or higher and satisfying the properties equivalent to or greater than the strength calculated from the following Equation 3, which high strength polypropylene (PP) fiber is prepared by applying an instantaneous localized heating at high temperature in the immediate vicinity of the spinning nozzle during the melt spinning step to heat up a PP polymer having a melt flow index (MFI) of 3 to 3000, more preferably 3 to 200, most preferably 10 to 35 and then performing the subsequent spinning, drawing and cooling steps [Refer to Table 4].

Tensile strength (g/d)=−0.225×Melt flow index (MFI) of PP fiber+12.925 [Equation 3]

The melt flow index (MFI) of the PP resin and fiber is measured according to the ASTM D 1238 (MFI 230/2). More specifically, the PP resin is melted at 230° C. for about 6 minutes and then extruded through a 2 mm-diameter nozzle under a weight of 2.16 kg for 10 minutes, and the weight (g/10 min) of the extruded resin is measured.

Accordingly, the instantaneous localized heating method of applying a localized heating at high temperature in the immediate vicinity of the nozzle during the melt spinning process in the present invention can be used to produce high strength polyolefin fibers with relatively high properties unattainable from the melt flow index (MFI) of the existing fibers, using a group of polyolefin fibers with different values of melt flow index (MFI).

Providing high strength synthetic fibers from the above-described preparation method, the present invention is available to a variety of applications, including interior materials of transportation, such as tire cord, automobile, train, airplane, ship, etc., civil engineering and construction materials, electronic materials, and marine and military applications, such as rope, net, etc., and furthermore, clothing and household applications, such as lightweight sportswear, working clothes, military uniforms, etc., and furniture, interiors, and sporting goods, thereby securing extensive markets.

Hereinafter, the present invention will be described in further detail with reference to the preferred embodiments.

The embodiments of the present invention are given for the illustrations of the present invention only and not construed to limit the scope of the present invention.

[Example 1] Preparation of High Strength PET Fiber by Heating Method of First Embodiment A polyethylene terephthalate (PET) resin (intrinsic viscosity 1.20 dl/g) was introduced into an extruder for melt extrusion and applied to a spinning nozzle at 300 C°. At this point, the resin was spun while surrounded with the pack body maintained at the same temperature (300 C°) of the spinning nozzle under a heat from the pack-body heater, to form an undrawn or partially drawn PET fiber. The extruded fiber immediately after the extrusion passes through a heating zone 40 to apply an indirect heating. The heating zone 40 comprises the insulator 43 and the high-temperature heater 41, which has the same hole structure and the same number as the spinning nozzles located at a position in the immediate vicinity of capillary in the spinning nozzle to a length of 5 mm and 10 mm, respectively. The high-temperature heater 41 was designed to have a plurality of heating channel having a radius of greater than 10 mm from the center of each capillary of the spinning nozzle, so the extruded fiber from the extruder capillary after the spinning step was heated up without in direct contact with the insulator 43, and the high-temperature heater 41 while passing through the heating zone 40.

(1) Spinning Conditions

Resin: PET (Iv: 1.20)

Spinning temperature (nozzle temp.): 300 C°

Diameter of capillary: Φ 0.5

Throughput rate per capillary: 3.3 g/min

Local heating temperature of heater right under nozzle: nozzle temperature plus 100 C° or above

[Example 2] Preparation of High Strength PET Fiber by Heating Method of Second Embodiment A polyethylene terephthalate (PET) resin (intrinsic viscosity 1.20 dl/g) was introduced into an extruder for melt extrusion and applied to a spinning nozzle at 297 C°. At this point, the resin was spun while surrounded with the pack body maintained at the same temperature of the spinning nozzle under a heat from the pack-body heater, to form an undrawn or partially drawn PET fiber. The extruded fiber immediately after the extrusion passes through a heating zone 80 to apply a direct/indirect heating. The spinning nozzle was protruded to be 2 mm long from the pack body. The high-temperature heater 81 with heating channels having the same structure and number of the capillaries was arranged to a length of 20 mm within a distance of 5 mm or less from the bottom of the spinning nozzle with no insulator, to form a heating zone 80.

The high-temperature heater 81 was designed to have a plurality of heating channel having a radius of greater than 10 mm from the center of each capillary of the spinning nozzle, so the extruded fiber from the capillary after the spinning step was heated up without in direct contact with the heater. The spinning process was performed in the same manner as described in Example 1 under the same spinning conditions. The results are presented in Table 1.

TABLE 1

| Div. | | Comparative Example 1 | | Example 1 | | Example 2 | |
|---|---|---|---|---|---|---|---|
| Local heater right under nozzle (temp.) | | None | | First embodiment (nozzle temp. +100° C. or above) | | Second embodiment (nozzle temp. +100° C. or above) | |
| I.V. of PET resin (dl/g) | | 1.2 | | 1.2 | | 1.2 | |
| I.V. of spun fiber (dl/g)[1] | | 0.932 | | 0.931 | | 0.935 | |
| Fiber properties[2] | Spinning rate (km/min) | S[3] (g/d) | E[4] (%) | S[3] (g/d) | E[4] (%) | S[3] (g/d) | E[4] (%) |
| | 0.5 | 1.71 | 666.4 | 1.71 | 684.2 | 1.72 | 707.9 |
| | 1 | 1.77 | 458.8 | 1.82 | 483.5 | 1.93 | 531.5 |
| | 2 | 2.82 | 269.7 | 2.88 | 280.1 | 3.01 | 315.3 |

[1]Free drop as-spun fiber

[2]Measurement conditions: Gauge length 20 mm & test speed 20 mm/min

[3]Tensile strength (g/d)

[4]Elongation (%)

As can be seen from Table 1, the polyethylene terephthalate (PET) fibers of Examples 1 and 2 as prepared by a high temperature localized in the immediate vicinity of the nozzle had no change in the intrinsic viscosity during the spinning process, thereby not incurring a degradation.

Further, the PET fibers of Examples 1 and 2 had the higher properties, such as tensile strength and elongation, than the fiber prepared by the conventional method. This result shows that the high temperature localized heating at the immediate vicinity of the nozzle can control of the molecular entanglement structure so to enhance the properties.

Particularly, the fiber of the second embodiment had the higher enhancement of the fiber properties, including tensile strength and elongation. This explicitly showed that the direct/indirect localized heating of the molten spinning fiber was more preferable. It was also found out that an additional improvement of the strength was achievable at higher heating temperature.

[Examples 3 and 4] Preparation of High Strength PET Fiber by Heating Method of Second Embodiment The procedures were performed in the same manner as described in Example 2 to form high strength PET fibers, excepting that the localized heating at high temperature in the immediate vicinity of the nozzle according to the second embodiment of the present invention was carried out with a different intrinsic viscosity of the PET polymer as presented in Table 2 to proceed the low-speed spinning and off-line drawing process as follows.

(1) Spinning Conditions

Resin: PET (Iv: 0.65 and 1.20)

Spinning temperature (nozzle temp.): 280 to 300 C°

Diameter of capillary: Φ 0.5

Throughput rate per capillary: 3.3 g/min

Local heating temperature of heater right under nozzle: nozzle temperature plus 100 C° or above Spinning rate: 1 k/min (2) Drawing Conditions Undrawn fiber: PET as-spun fiber obtained under the above-defined spinning conditions First godet roll speed (temp.): 10 m/min (85 C°)

Drawing stage number: at least 3 stages

Sampling the drawn fiber at the maximum drawing ratio available for continuous drawing without breaks of the fiber (heat setting temperature 130 to 180 C°)

TABLE 2

| Div. | | | | Example | | Comparative example | |
|---|---|---|---|---|---|---|---|
| | | | | 3 | 4 | 2 | 3 |
| Local heater right under nozzle (temp.) | | | | Second embodiment (nozzle temp. +100° C.) | | None | |
| | I.V. of PET resin | | dl/g | 0.65 | 1.2 | 0.65 | 1.2 |
| Fiber | As-spun | Strength | g/d | 2.05 | 1.93 | 1.94 | 1.77 |

TABLE 2-continued

| Div. | | | | Example 3 | Example 4 | Comparative example 2 | Comparative example 3 |
|---|---|---|---|---|---|---|---|
| property (PET)[1] | fiber (undrawn)[2] | Elongation | % | 545.3 | 531.5 | 504.6 | 458.8 |
| | Drawn fiber[3] | Strength | g/d | 6.78 | 12.15 | 5.87 | 10.35 |
| | | Elongation | % | 18.4 | 12.8 | 19.4 | 13.2 |
| I.V.[4] of as-spun fiber | | | dl/g | 0.621 | 0.935 | 0.622 | 0.932 |

[1]Measurement conditions: Gauge length 20 mm & test speed 20 mm/min
[2]Spinning rate 1 km/min
[3]Drawn fiber obtained at the maximum drawing ratio available for continuous draw
[4]Free fall as-spun fiber As can be seen from Table 2, there was no change in the intrinsic viscosity during the spinning process in the case of the fibers of Examples 3 and 4 prepared from the PET resins having an intrinsic viscosity of 0.65 and 1.2, respectively, using an instantaneous localized heating at high temperature in the immediate vicinity of the nozzle and the fibers of Comparative Examples 2 and 3 obtained by the same procedures of Examples 3 and 4 but without using a localized heating at high temperature in the immediate vicinity of the nozzle. This shows that the instantaneous localized heating at high temperature in the immediate vicinity of the nozzle prevented the occurrence of degradation.

Further, the undrawn (as-spun) and drawn fibers prepared in Examples 3 and 4 were superior in the properties, such as tensile strength and elongation, to the fibers prepared in Comparative Examples 2 and 3 according to the same procedures of Examples 3 and 4 but without using a localized heating at high temperature in the immediate vicinity of the nozzle. It can be shown that both the lower and higher molecular PET resins were improved in terms of properties due to the control of the molecular entanglement structure using a localized heating at high temperature in the immediate vicinity of the nozzle.

Particularly, both the lower and higher molecular PET fibers in Examples 3 and 4 had the improvement of the strength by 10% or greater at the same elongation as compared with the existing fibers of Comparative Examples 2 and 3.

[Examples 5 and 6] Preparation of High Strength Nylon Fiber by Heating Method of Second Embodiment Nylon 6 resins having a relative viscosity (Rv) of 2.6 and 3.4 dl/g, respectively, were introduced into an extruder for melt extrusion and applied to a spinning nozzle at 270 C°. At this point, the extruded fibers were heated by a high temperature localized heating at the immediate vicinity of the nozzle according to the second embodiment during the spinning process and then subjected to the low-speed spinning and off-line drawing processes as follows to form nylon 6 fibers. In Comparative Examples 4 and 5, the same procedures were performed; excepting that a high temperature localized in the immediate vicinity of the—nozzle was not used. The results are presented in Table 3.

(1) Spinning Conditions

Resin: Nylon 6 (Rv: 2.6 and 3.4)

Spinning temperature (nozzle temp.): 250 to 270 C°

Diameter of capillary: Φ 0.5

Throughput rate per capillary: 3.3 g/min

Local heating temperature of heater right under nozzle: nozzle temperature plus 100 C° or above Spinning rate: 1 k/min (2) Off-Line Drawing Conditions Undrawn fiber: Nylon 6 as-spun fiber obtained under the above-defined spinning conditions First godet roll speed (temp.): 10 m/min (85 C°)

Drawing stage number: at least 3 stages

Sampling the drawn fiber at the maximum drawing ratio available for continuous drawing without breaks of the fiber (heat setting temperature 130 to 180 C°)

TABLE 3

| Div. | | | | Example 5 | Example 6 | Comparative example 4 | Comparative example 5 |
|---|---|---|---|---|---|---|---|
| Local heater right under nozzle (temp.) | | | | Second embodiment (nozzle temp. +100° C.) | | None | |
| Rv of nylon 6 resin (in $H_2SO_4$) | | | | 2.6 | 3.4 | 2.6 | 3.4 |
| Fiber property (nylon 6)[1] | As-spun fiber (undrawn)[2] | Strength | g/d | 2.16 | 2.31 | 2.05 | 2.11 |
| | | Elongation | % | 537.6 | 524.2 | 502.5 | 467.2 |
| | Drawn fiber[3] | Strength | g/d | 6.86 | 11.13 | 6.14 | 9.72 |
| | | Elongation | % | 18.9 | 19.6 | 18.6 | 19.5 |
| Rv[4] of as-spun fiber (in $H_2SO_4$) | | | | 2.4 | 3 | 2.4 | 3 |

[1]Measurement conditions: Gauge length 20 mm & test speed 20 mm/min
[2]Spinning rate 1 km/min
[3]Drawn fiber obtained at the maximum drawing ratio available for continuous draw
[4]Free fall as-spun fiber As can be seen from Table 3, there was no change in the relative viscosity during the spinning process in the case of the fibers of Examples 5 and 6 prepared from the nylon 6 resins having a relative viscosity of 2.6 and 3.4, respectively, compared to Comparative Examples 4 and 5. This shows that an instantaneously high temperature localized heating at the immediate vicinity of the nozzle prevented the occurrence of degradation.

Further, the undrawn (as-spun) and drawn fibers prepared in Examples 5 and 6 using an instantaneously high temperature localized heating at the immediate vicinity of the nozzle were superior in the properties, such as tensile strength and elongation, to the fibers of Comparative Examples 4 and 5. It can be shown that both the lower and higher molecular weight of nylon 6 resins having a relative viscosity of 2.6 and 3.4 were improved in terms of properties due to the control of the molecular entanglement structure.

Particularly, both the lower and higher molecular nylon 6 fibers in Examples 5 and 6 had the improvement of the strength by 10% or greater at the same elongation as compared with the existing fibers of Comparative Examples 4 and 5.

[Examples 7 and 8] Preparation of High Strength PP Fiber by Heating Method of Second Embodiment PP resins having a melt flow index (MFI) of 33 and 12, respectively, were introduced into an extruder for melt extrusion and applied to a spinning nozzle at 270 C°. At this point, the resins were heated by a localized heating at high temperature in the immediate vicinity of the nozzle according to the second embodiment during the spinning process and then subjected to the spinning and drawing processes as follows to form PP fibers. In Comparative Examples 6 and 7, the same procedures were performed; excepting that a high temperature localized heating at the immediate vicinity of the nozzle was not used. The results are presented in Table 4.

(1) Spinning Conditions

Resin: PP (MFI (190/5): 33 and 12)

Spinning temperature (nozzle temp.): 210 to 270 C°

Diameter of capillary: Φ 0.5

Throughput rate per capillary: 3.3 g/min

Local heating temperature of heater right under nozzle: nozzle temperature plus 100 C° or above Spinning rate: 1 k/min (2) Off-Line Drawing Conditions Undrawn fiber: PP fiber obtained under the above-defined spinning conditions First godet roll speed (temp.): 10 m/min (85 C°)

Drawing stage number: at least 3 stages

Sampling the drawn fiber at the maximum drawing ratio available for continuous drawing without breaks of the fiber (heat setting temperature 130 to 180 C°)

TABLE 4

| Div. | | | | Example 7 | Example 8 | Comparative example 6 | Comparative example 7 |
|---|---|---|---|---|---|---|---|
| Local heater right under nozzle (temp.) | | | | Second embodiment (nozzle temp. +100° C.) | | None | |
| MFI (190/5)[5] of PP resin | | | g/10 min | 33 | 12 | 33 | 12 |
| Fiber property (PP)[1] | As-spun fiber (undrawn)[2] | Strength | g/d | 2.16 | 1.76 | 1.52 | 1.68 |
| | | Elongation | % | 451.9 | 485.6 | 423.6 | 453.7 |
| | Drawn fiber[3] | Strength | g/d | 6.05 | 10.51 | 5.32 | 9.57 |
| | | Elongation | % | 18.2 | 17.5 | 18.6 | 18.8 |
| MFI (190/5)[4] of as-spun fiber | | | g/10 min | 34 | 13 | 34 | 13 |

[1]Measurement conditions: Gauge length 20 mm & test speed 20 mm/min
[2]Spinning rate 1 km/min
[3]Drawn fiber obtained at the maximum drawing ratio available for continuous draw
[4]Free fall as-spun fiber As can be seen from Table 4, there was no change in the melt flow index (MFI) during the spinning process in the case of the fibers of Examples 7 and 8 prepared from the PP resins having a melt flow index (MFI) of 33 and 12, respectively and the fibers of Comparative Examples 6 and 7 obtained by the same procedures of Examples 7 and 8 but without using a localized heating at high temperature in the immediate vicinity of the nozzle. This shows that the instantaneously high temperature localized heating at the immediate vicinity of the nozzle prevented the occurrence of degradation.

Further, the undrawn (as-spun) and drawn fibers prepared in Examples 7 and 8 were superior in the properties, such as tensile strength and elongation, to the fibers of Comparative Examples 6 and 7. It can be shown that both the lower and higher molecular PP resins were improved in terms of properties due to the control of the molecular entanglement structure by an instantaneously high temperature localized heating at the immediate vicinity of capillary in the spinning nozzle.

Particularly, both the lower and higher molecular PP fibers in Examples 7 and 8 had the improvement of the strength by 10% or greater at the same elongation as compared with the existing fibers of Comparative Examples 6 and 7.

INDUSTRIAL AVAILABILITY

As described above, the preparation method of the present invention is optimizing the heating method for the polymer being spun in the melt-spinning process and dropped right from the spinning nozzle. More specifically, it includes applying a single or double heating process to the multifilaments in the immediate vicinity of capillary of the commonly-used spinning nozzle to optimize the heat transfer, thereby controlling the molecular entanglement structure of the molten polymer through an instantaneous heating to high temperature to enhance the drawability of the fiber and to improve the strength and elongation.

The preparation method for high strength synthetic fiber according to the present invention uses the existing melt-spinning and drawing processes and improves the mechanical properties to reduce the initial investment cost and to enable the mass production of high performance fibers at a low cost.

Providing high strength synthetic fibers including PET, nylon and PP fibers from the thermoplastic polymers, the present invention is available to a variety of applications, including interior materials of transportation, such as tire cord, automobile, train, airplane, ship, etc., civil engineering and construction materials, electronic materials, and marine and military applications, such as rope, net, etc., and furthermore, clothing and household applications, such as lightweight sportswear, working clothes, military uniforms, etc., and furniture, interiors, and sporting goods, thereby securing extensive markets.

Particularly, by providing high strength PET fibers, the present invention is also applicable to the textile applications, such as long fiber, short fiber, unwoven fabric, etc. and possibly extendable to the manufacture of films, sheets, molded products, containers, etc. using those textile materials.

The foregoing description of the invention has been presented for purposes of illustration and description, and obviously many modifications and variations are possible without departing from the principles and the substantial scope of the present invention. The scope or the claims of the present invention includes such modifications and variations belonging to the principles of the present invent on.

DESCRIPTION OF SYMBOLS

10,50: molten polymer materials
11,51: capillary
12,52: spinning nozzle
20,60: pack body
30,70: pack-body heater
40,80: heating zone
41,81: high-temperature heater
41*a*,41*b*,81*a*,81*b*: heating channel
43: insulator
F: fiber

What is claimed is:

1. A method of manufacturing high strength synthetic fiber, comprising:

melt-spinning a thermoplastic polymer through a spinning nozzle containing at least one capillary to form molten fiber;

passing the molten fiber through a heating zone (40 or 80) located in the immediate vicinity of the spinning nozzle (12 or 52) to heat the fiber;

cooling down the heated fiber; and drawing the cooled fiber and then winding the drawn fiber, wherein the molten fiber is locally heated by passing through the heating zone (40 or 80) including a high-temperature heater (41 or 81) provided in the form of a hole-type heating channel (41*a* or 81*a*) or a band-type heating channel (41*b* or 81*b*) formed on the periphery of the capillary of the spinning nozzle, wherein the molten fiber passes through a high-temperature heater (41 or 81) provided in the form of a plurality of a hole-type heating channel (41*a* or 81*a*) having apart from the center of each capillary of the spinning nozzle at a distance of 1 to 300 mm.

2. The method as claimed in claim 1, wherein the thermoplastic polymer comprises any one selected from a polyester-based polymer selected from the group consisting of polyethylene terephthalate (PET), polybutylene terephthalate (PBT), polytrimethylene terephthalate (PTT), polycyclohexane dimethanol terephthalate (PCT), and polyethylene naphthalate (PEN); a polyamide-based polymer selected from the group consisting of nylon 6, nylon 6,6, nylon 4, and nylon 4,6; or a polyolefin-based polymer selected from the group consisting of polyethylene and polypropylene.

3. The method as claimed in claim 1, wherein the molten fiber is locally heated up to high temperature instantaneously when passing through the high-temperature heater (41 or 81) having a temperature difference of 0 to 1,500° C. from a pack body (20 or 60).

4. The method as claimed in claim 3, wherein the pack body (20 or 60) is maintained at temperature of 50 to 400° C.

5. The method as claimed in claim 1, wherein the fiber passes through a high-temperature heater (41 or 81) provided in the form of a plurality of a band-type heating channel (41*b* or 81*b*) formed in an arrangement disposed between adjacent capillaries, when the plurality of the capillary are arranged in a same radius from the center of the spinning nozzle.

6. The method as claimed in claim 1, wherein the heating zone (40) is defined to include an insulator (43) having a thickness of 1 to 30 mm below the bottom of the spinning nozzle and a high-temperature heater (41) extending to a length of 1 to 500 mm from the insulator.

7. The method as claimed in claim 1, wherein the heating zone (80) is defined to include a high-temperature heater (81) is in contact with or partly inserted into the bottom of a spinning nozzle (52), the bottom of the spinning nozzle (52) being positioned at a distance of −50 mm (inside the pack body) to 300 mm (outside the pack body) from the bottom of a pack body, wherein the high-temperature heater (81) is inserted into the bottom of the spinning nozzle (52) to an insertion length of 0 to 50 mm and extends from the bottom of the spinning nozzle to an extension length of 0 to 500 mm.

8. The method as claimed in claim 1, wherein the thermoplastic polymer passing through each capillary (11 or 51) of the spinning nozzle (12 or 52) has a residence time of 3 seconds or less and a throughput rate of at least 0.01 cc/min.

9. The method as claimed in claim 1, wherein the shear rate on the wall surface of a capillary in the spinning nozzle (12 or 52) is 500 to 500,000/sec.

10. The method as claimed in claim 1, wherein the capillary (11 or 51) of the spinning nozzle (12 or 52) has a structure with a diameter (D) of 0.01 to 5 mm, a length (L), wherein L/D is 1 or greater, a pitch (the distance of the adjacent two capillaries) of 1 mm or greater, and a cross-section taking a circular shape or a noncircular shape.

11. The method as claimed in claim 1, wherein the spinning nozzle (12 or 52) is a nozzle for at least one single or multicomponent spinning method selected from the group consisting of sheath-core type, side-by-side type, and islands in the sea type.

* * * * *